US006294789B1

(12) United States Patent
Jing

(10) Patent No.: US 6,294,789 B1
(45) Date of Patent: Sep. 25, 2001

(54) RADIATION INTENSIFYING SCREEN

(75) Inventor: Zhenxue Jing, Danbury, CT (US)

(73) Assignee: Hologic, Inc., Bedford, MA (US)

( * ) Notice: Subject to any disclaimer, the term of this patent is extended or adjusted under 35 U.S.C. 154(b) by 0 days.

(21) Appl. No.: 09/321,933

(22) Filed: May 28, 1999

Related U.S. Application Data

(60) Provisional application No. 60/089,563, filed on Jun. 17, 1998.

(51) Int. Cl.[7] ..... G21K 4/00

(52) U.S. Cl. ..... 250/367; 250/484.3; 250/368; 250/486.1; 250/484.1

(58) Field of Search ..... 250/367, 484.1, 250/484.3, 368, 486.1

(56) References Cited

U.S. PATENT DOCUMENTS

| | | | |
|---|---|---|---|
| 2,827,571 | 3/1958 | Klasens et al. . | |
| 3,584,216 | 6/1971 | Tinney . | |
| 3,717,764 | 2/1973 | Fujimura et al. . | |
| 3,944,835 | 3/1976 | Vosburgh . | |
| 4,101,781 | 7/1978 | Neukermans et al. . | |
| 4,415,810 | 11/1983 | Brown, Sr. . | |
| 4,488,047 * | 12/1984 | Thomas | 250/368 |
| 4,603,259 | 7/1986 | Rabatin . | |
| 4,621,196 | 11/1986 | Arakawa . | |
| 5,380,636 | 1/1995 | Malfatto et al. . | |
| 5,381,015 | 1/1995 | Dooms . | |
| 5,432,351 | 7/1995 | Pesce et al. . | |
| 5,461,660 | 10/1995 | Dooms et al. . | |
| 5,636,299 * | 6/1997 | Bueno et al. | 250/367 |
| 5,751,787 | 5/1998 | Jing et al. . | |

FOREIGN PATENT DOCUMENTS

| | | |
|---|---|---|
| 0583844 | 2/1994 | (EP) . |
| 2115485 | 12/1990 | (JP) . |
| 2297099 | 12/1990 | (JP) . |

* cited by examiner

*Primary Examiner*—Constantine Hannaher
*Assistant Examiner*—Andrew Israel
(74) *Attorney, Agent, or Firm*—Ware, Fressola, Van Der Sluys & Aldolphson LLP

(57) ABSTRACT

A radiation intensifying screen is formed by a reflective-transmissive layer which is disposed between two radiation absorbing, luminescent phosphor layers having emission maximum wavelengths which are well separated. The reflective-transmissive layer is either a long wave pass or short wave pass filter which provides maximum reflection for spectral emissions produced in the first luminescent layer but, at the same time, allows the maximum transmission of spectral emissions produced in the second luminescent layer. An optional secondary reflective layer and a backing layer are provided adjacent to the second luminescent layer. As a result, spectral emissions in the first luminescent layer have a relatively short traveling path compared to the path in a conventional intensifying screen. The disclosed dual layer intensifying screen construction increases the spatial resolution of the phosphor screen without adversely affecting the screen speed.

20 Claims, 4 Drawing Sheets

RADIATION INTENSIFYING SCREEN

This application claims benefit of provisional application 60/089,563 Jun. 17, 1998.

BACKGROUND OF THE INVENTION

1. Field of the Invention

The present invention generally relates to screens which convert incident radiation, such as X-rays, into spectral emissions such as visible light. More particularly, the present invention relates to a radiation intensifying screen having two luminescent material layers with different spectral emission wavelength ranges and different emission maximum wavelengths separated by a reflective-transmissive layer which reflects the spectral emissions emanating from one of the luminescent material layers and allows spectral emissions from the other layer to pass therethrough. The configuration of the screen increases spatial resolution for a given screen speed.

2. Description of the Prior Art

X-ray intensifying screens have been widely used in medical and industrial imaging systems. An intensifying screen is a device that absorbs incident x-ray radiation and converts the incident radiation energy into spectral emissions of predetermined wavelengths. The radiation absorbing, spectral emitting material in an intensifying screen is typically a phosphor. The wavelengths of the spectral emissions from most phosphors used in intensifying screens are typically in the visible portion of the electromagnetic spectrum. The spectral emissions from the phosphor is received by a detector (such as radiographic film) which is responsive to the wavelengths of the spectral emissions to form an image of an object that has been subjected to the incident radiation.

One of the common objects of medical imaging is to maximize image contrast and spatial resolution while minimizing radiation dose to the patient. Spatial resolution is related to the ability of an imaging system to reproduce an image of an object faithfully. Generally, conditions that increase the intensification factor or speed of the screen typically reduce its spatial resolution. Speed or intensification factor increases can be obtained by increasing the thickness of the radiation absorbing, luminescent layer and by using relatively larger phosphor crystals. Resolution can generally be improved by using smaller phosphor crystals and thinner radiation absorbing, luminescent layers.

The intensification factor of screens can also be increased by using a reflective layer adjacent to the radiation absorbing, luminescent or phosphor layer. Referring to FIG. 1, a conventional X-ray intensifying screen 10 of the reflective type typically comprises a protective layer 12, a radiation absorbing, luminescent layer 14, a reflective layer 16 and a backing layer 18. Incident X-ray absorption at locations A and B in the radiation absorbing, luminescent layer produces spectral emissions in the visible light wavelength range in the layer which emit isotropically through the layer. Spectral emissions in the form of visible light A', B' emitted towards the protective layer have a relatively short path before emerging from the screen, thereby producing image information with relatively high spatial resolution. On the other hand, spectral emissions in the form of visible light A", B" emitted toward the backing layer may be reflected at the reflective layer and, if so, then exits the screen from the protective layer side. As compared to the light photons A', B' emitted towards the protective layer, the reflected light photons A", B" travel a longer path in the phosphor and generally have a large lateral dispersion from their emission sites. The longer lateral dispersion results in reduced spatial resolution.

As those skilled in the art will appreciate, the purpose of the reflective layer in an X-ray intensifying screen is to increase the speed of the luminescent screen which may enable suitable image contrast at a lower radiation dosage. Although this reflective layer nearly doubles the amount of visible light that can emerge from the screen, it does so at the expense of screen spatial resolution. In some applications such as mammography where high resolution is required, the reflective layer is not used. This improves the screen's spatial resolution at the expense of screen speed. As a result, high radiation doses to the objects (e.g., patients) being imaged are generally required to get adequate image contrast.

It would be desirable to increase the speed of an intensifying screen without severely degrading spatial resolution, Stated in the alternative, it would be desirable to increase the speed of an intensifying screen of a given spatial resolution or increase the spatial resolution of an intensifying screen of a given speed.

SUMMARY OF THE INVENTION

Accordingly, it is a principal object of the present invention to provide a screen which converts incident X-ray radiation into visible light.

It is another object of the present invention to increase the spatial resolution of an intensifying screen of a given speed.

It is another object of the present invention to increase the speed of an intensifying screen of a given spatial resolution.

These objects are accomplished, at least in part, by providing a radiation intensifying screen which includes a first radiation absorbing, luminescent layer formed from a first luminescing mate rial capable of producing a spectral emissions maximum at first predetermined wavelength in response to incident radiation and a second radiation absorbing, luminescent layer formed from a second luminescing material capable of producing a spectral emissions maximum at a second predetermined wavelength which is different from the first predetermined wavelength in response to incident radiation. The intensifying screen also includes a reflective-transmissive layer, disposed between the first and second luminescent layers, for reflecting incident spectral emissions emanating from the first luminescent layer at the first predetermined wavelength and for allowing spectral emissions emanating from the second luminescent layer at the second predetermined wavelength to pass there through. In addition to the first and second luminescent layers and the first reflective layer, the screen optionally includes a backing layer disposed adjacent to the second luminescent layer and, if desired, a secondary reflective layer, disposed between the second luminescent layer and the backing layer, for reflecting incident spectral emissions emanating from the second luminescent layer at the second predetermined wavelength.

BRIEF DESCRIPTION OF THE DRAWINGS

The drawings, not drawn to scale, include.

DETAILED DESCRIPTION OF THE INVENTION

Figure 2:
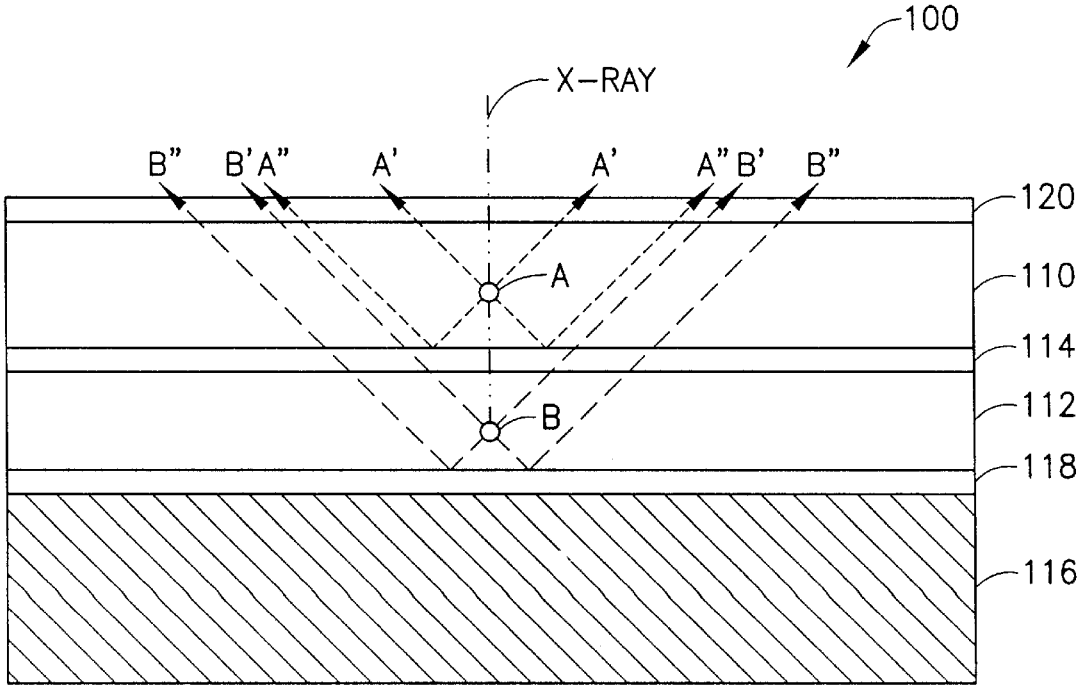
FIG. 2, which is a cross-sectional schematic diagram illustrating an intensifying screen made according to the present invention which includes a first reflective layer sandwiched between two luminescent layers and the spectral emission propagation within the screen.

Referring to FIG. 2, an intensifying screen 100 made according to the present invention includes a first radiation absorbing, luminescent layer 110 which is formed from a first luminescing material capable of producing spectral emissions of known varying wavelengths in response to incident radiation. The first luminescing material also has a known maximum emission wavelength. Preferably, the first luminescing material is a phosphor material.

The intensifying screen also includes a second radiation absorbing, luminescent layer 112 which is formed from a second luminescing material capable of producing spectral emissions of known varying wavelengths in response to incident radiation. The second luminescing material also has a known maximum emission wavelength which is either greater than or less than the known maximum emission wavelength of the first luminescing material. Preferably, the second luminescing material is a phosphor.

Table 1 below lists some of the phosphors and their emission spectrum ranges that can be used in the present invention. Any combination of two phosphors with spectral emissions not completely overlapped can be used in the present invention. Ideally, in the present invention, the first and second luminescing materials should be selected to ensure that the wavelengths of their respective spectral emission maximums are well separated

TABLE 1

| Phosphor | Light Emission Spectrum Range (nm) |
|---|---|
| Calcium Tungstate (CaWO4) | 340–540 |
| Terbium activated Gadolinium Oxysulfide ($Gd_2O_2S$:Tb) | 400–650 |
| Europium activated Gadolinium Oxysulfide ($Gd_2O_2S$:Eu) | 570–700 |
| Terbium activated Yttrium Oxysulfide ($Y_2O_2S$:Tb) | 400–650 |
| Europium activated Yttrium Oxysulfide ($Y_2O_2S$:Eu) | 570–700 |
| Terbium activated Lanthanum Oxysulfide ($La_2O_2S$:Tb) | 400–650 |
| Europium activated Lanthanum Oxysulfide ($La_2O_2S$:Eu) | 570–700 |
| Lanthanum Oxybromide (LaOBr) | 360–620 |
| Barium Strontium Sulfate ($BaSO_4$:Eu) | 330–430 |
| Barium Fluorochloride (BaFCl:Eu) | 350–450 |
| Barium Lead Sulfate ($BaPbSO_4$) | 300–500 |
| Zinc Cadmium Sulfide ((Zn,Cd)S:Ag) | 450–650 |
| Terbium activated Zinc Sulfide (ZnS:Tb) | 400–650 |
| Europium activated Zinc Sulfide (ZnS:Eu) | 530–700 |
| Terbium activated Yttria ($Y_2O_3$:Tb) | 400–650 |
| Europium activated Yttria ($Y_2O_3$:Eu) | 570–700 |

Figure 3A:
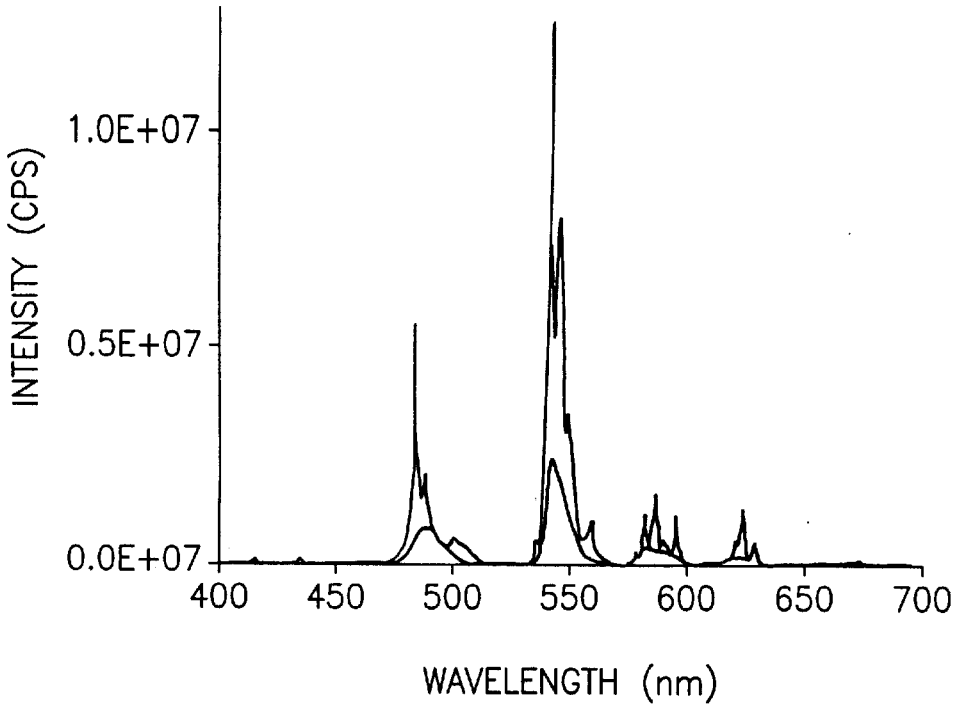
FIGS. 3A, and 3B which are plots of the spectral emissions of two phosphors.
Figure 3B:
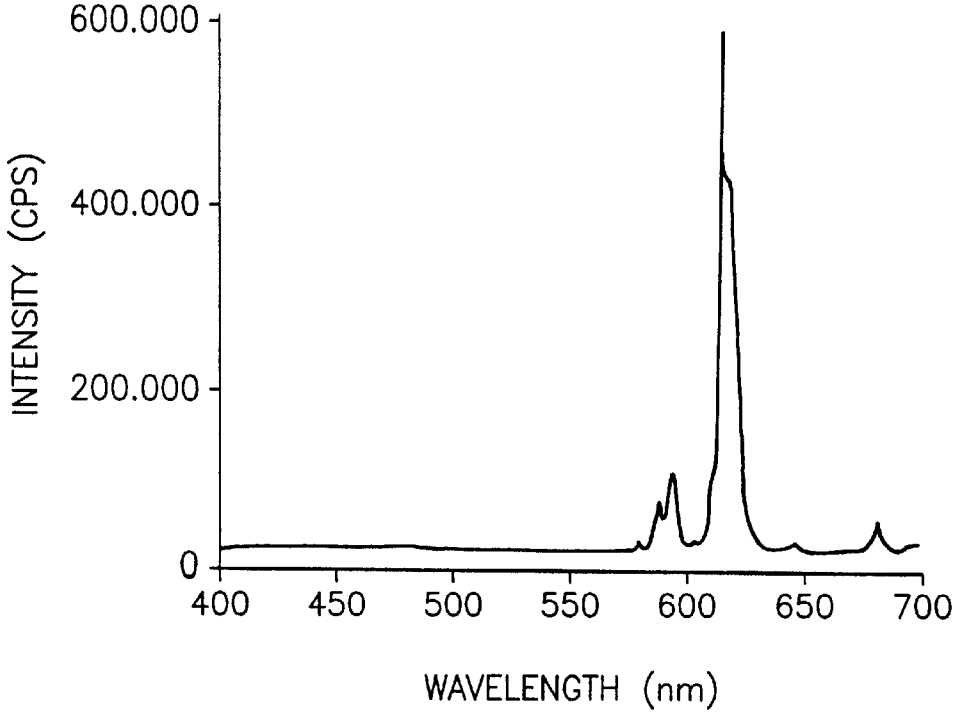

FIGS. 3A and 3B illustrate the spectral emission wavelength ranges and spectral emission maximums of terbium activated yttria ($Y_2O_3$:Tb) and europium activated yttria ($Y_2O_3$:Eu), two phosphors which may be used together as the first and second radiation absorbing, luminescent layers 110, 112 in the present invention.

Figure 3C:
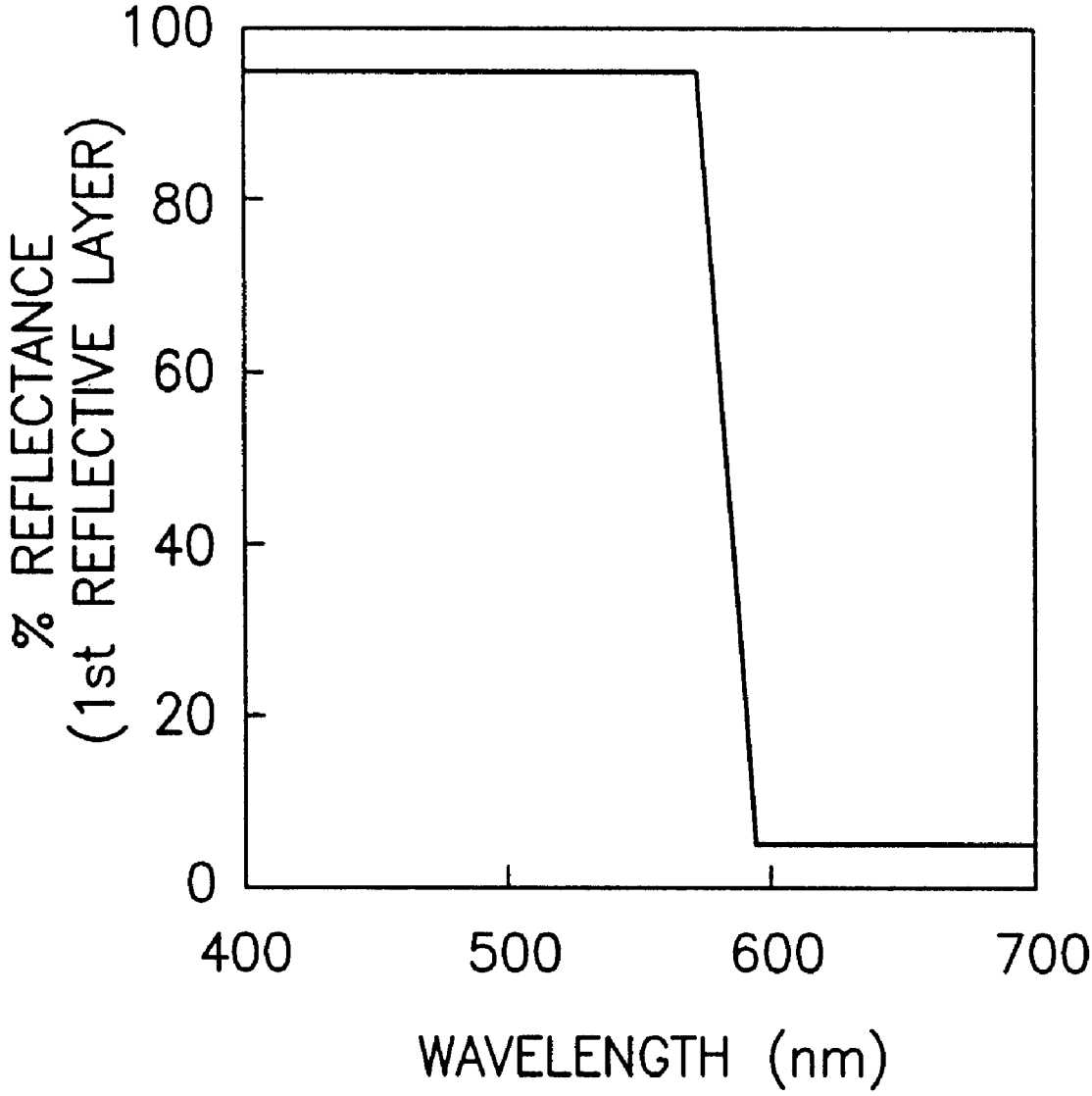
FIG. 3C which is a plot of the dependence of reflectance on wavelength for a material which may be used as the first reflective layer with the two phosphors having the spectral emissions plotted in FIGS. 3A and 3B.

In addition to the two luminescent layers, the intensifying screen 100 also has a reflective-transmissive layer 114 which is disposed between the first and second luminescent layers 110, 112. The reflective-transmissive layer 114 may be formed from glass or a transparent polymer having either a long pass or short pass optical coating (i.e., filter) thereon. Long and short pass optical filters which are glass or transparent polymer materials with such coatings are commercially available and therefore well known by those skilled in the art. A long pass filter transmits (or passes) a wide spectral band of long wavelength emissions (light) while reflecting short wavelength emissions. A short pass filter transmits (or passes) a wide spectral band of short wavelength emissions while reflecting long wavelength emissions. A long wave pass or short wave pass filter is characterized by a sharp transition from the wavelength region of maximum transmission to maximum reflection. FIG. 3C illustrates the sharp transition of a short pass filter. The type of filter utilized depends upon the wavelength ranges for the materials used to form the two luminescent layers 110, 112, which is typically adjustable in the visible to infrared wavelength range by design.

For example, if the material forming the first and second luminescent layers 110, 112 are chosen so that the first luminescent layer 110 has a spectral emissions wavelength range which is generally less than the spectral emissions wavelength range for the second luminescent layer 112, then the reflective-transmissive layer 114 is formed so that it is a long pass filter which is capable of reflecting incident spectral emissions of varying wavelengths that emanate from the first luminescent layer 110 which are less than the cutoff wavelength of the long pass filter material. Also, the long pass filter material forming the reflective-transmissive layer 114 is selected so that it is capable of transmitting incident spectral emissions of varying wavelengths that emanate from the second luminescent layer 112 which are greater than the cutoff wavelength of the long pass filter material.

Alternatively, if the material forming the first and second luminescent layers 110, 112 are chosen so that the first luminescent layer 110 has a spectral emissions wavelength range which is generally higher than the spectral emissions wavelength range for the second luminescent layer 112, then the reflective-transmissive layer 114 is formed as a short pass filter which is capable of reflecting incident spectral emissions of varying wavelengths that emanate from the first luminescent layer 110 which are greater than the cutoff wavelength of the short pass filter material. Also, the short pass filter material forming the reflective-transmissive layer 114 in this alternative embodiment is selected so that it is capable of transmitting incident spectral emissions of varying wavelengths that emanate from the second luminescent layer 112 which are less than the cutoff wavelength of the short pass filter material.

Preferably, in either embodiment described above, the material selected for the first and second luminescent layers 110, 112 and the reflective-transmissive layer 114 are chosen so that the cutoff wavelength is between the emission maximum wavelengths of the materials forming the two luminescent layers 110, 112. Ideally, the emission maximums of the two luminescent materials should be as far separated as possible, but a minimum of 20 nanometer wavelength separation will work.

Optionally, in addition to the first and second luminescent layers and the reflective-transmissive layer, the intensifying screen 100 also includes a backing layer 116 which is disposed adjacent to the second luminescent layer. The screen may also optionally include a secondary reflective layer 118 which is disposed between the second luminescent layer 112 and the backing layer 116. The optional secondary reflective layer 118 is adapted to reflect spectral emissions of varying wavelengths emanating from the second luminescent layer 112. Any glass or polymeric material having a suitable reflective coating may be used. Alternatively, a reflective coating may be applied on the backing layer. Also, a protective layer 120 may be applied over the first luminescent layer 110 in a conventional manner to provide resistance to screen surface abrasion. All of the layers of the intensifying screen of the present invention can be held together in any conventional manner.

Some examples of intensifying screens made according to the present invention are described below.

EXAMPLE 1

The first radiation absorbing, luminescent layer was composed of terbium activated yttria ($Y_2O_3$:Tb) phosphor. FIG. 3A shows the wavelength distribution of spectral emissions from $Y_2O_3$:Tb phosphor. The spectral emissions from this material have wavelengths ranging from about 400 to 650 nm and a maximum or peak emission wavelength at about 545 nm. The second radiation absorbing, luminescent layer was composed of europium activated yttria ($Y_2O_3$:Eu) phosphor. FIG. 3B shows the wavelength distribution of spectral emissions of $Y_2O_3$:Eu phosphor. As shown in FIG. 3B, the spectral emissions have wavelengths ranging from about 570 to 700 nm with a maximum or major peak emission wavelength at 620 nm. The reflective-transmissive layer was a long pass filter with a cutoff wavelength at about 580 nm. FIG. 3C shows the percent (%) reflectance of the long pass filter as a function of wavelength for this first reflective layer. The secondary reflective layer was formed as a thin (~20 $\mu$m thick) coating of magnesium oxide, or alternatively titanium dioxide, on the backing layer which reflects the $Y_2O_3$:Eu phosphor spectral emissions. The backing layer was a thin polyester sheet. The protective layer was a thin (approximately 1 to 2 $\mu$m thick) transparent film to resist screen surface abrasion.

EXAMPLE 2

The first radiation absorbing, luminescent layer was composed of europium activated barium fluorochloride (BaFCl:Eu) phosphor. Its emission spectrum ranges from 350 to 450 nm and peaks at about 380 nm. BaFCl:Eu is the phosphor material found in a commercially available screen sold under the trademark Dupont Quanta II. The second radiation absorbing, luminescent layer was composed of terbium activated gadolinium oxysulfide ($Gd_2O_2S$:Tb) phosphor. Its emission spectrum ranges from about 400 to 650 nm with a major peak at 545 nm. $Gd_2O_2S$:Tb is used in many commercially available screens, e.g., Eastman Kodak Lanex™ screens. The reflective-transmissive layer was a long pass filter with a cutoff wavelength at about 500 nm. The secondary reflective layer, backing layer and protective layers were the same as in Example 1.

Figure 4:
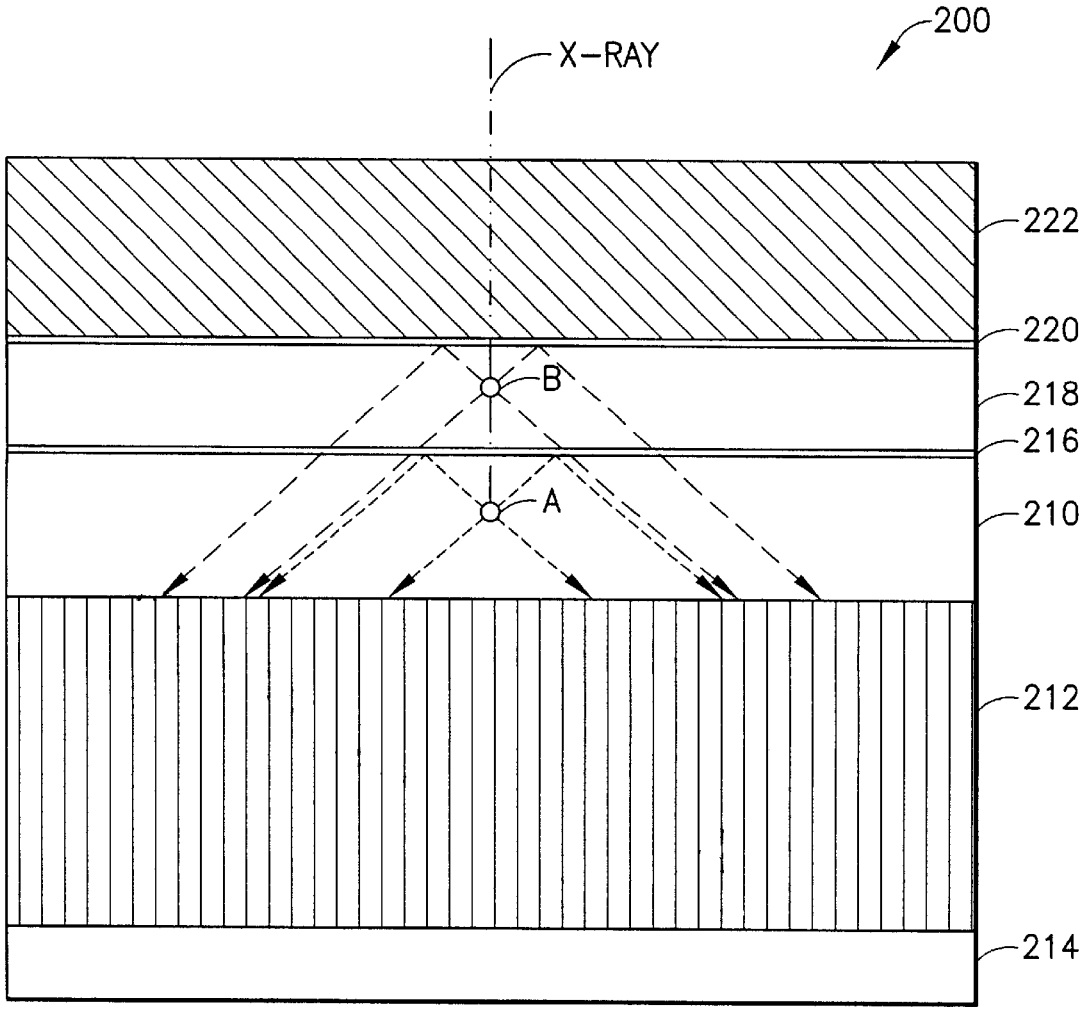
FIG. 4, which is a schematic diagram illustrating an alternative embodiment of the present invention as used in a digital imaging system.

FIG. 4 shows the present invention used in a digital imaging system. In this embodiment, the image intensifying screen 200 is formed by a first radiation absorbing, luminescent layer 210 which is directly deposited on top of an optical fiber plate 212 containing a plurality of optical fibers which optically couples the intensifier 200 to a charge-coupled device (CCD) 214. The CCD 214 converts the spectral emissions or light signals into electronic signals which are then processed to form a final image. CCD devices are well known in the art and therefore not described herein. In this embodiment, a reflective-transmissive layer 216 is provided between the first luminescent layer 210 and a second luminescent layer 218. An optional secondary reflective layer 220 is disposed between the second luminescent layer 218 and a backing layer 222.

Figure 1:
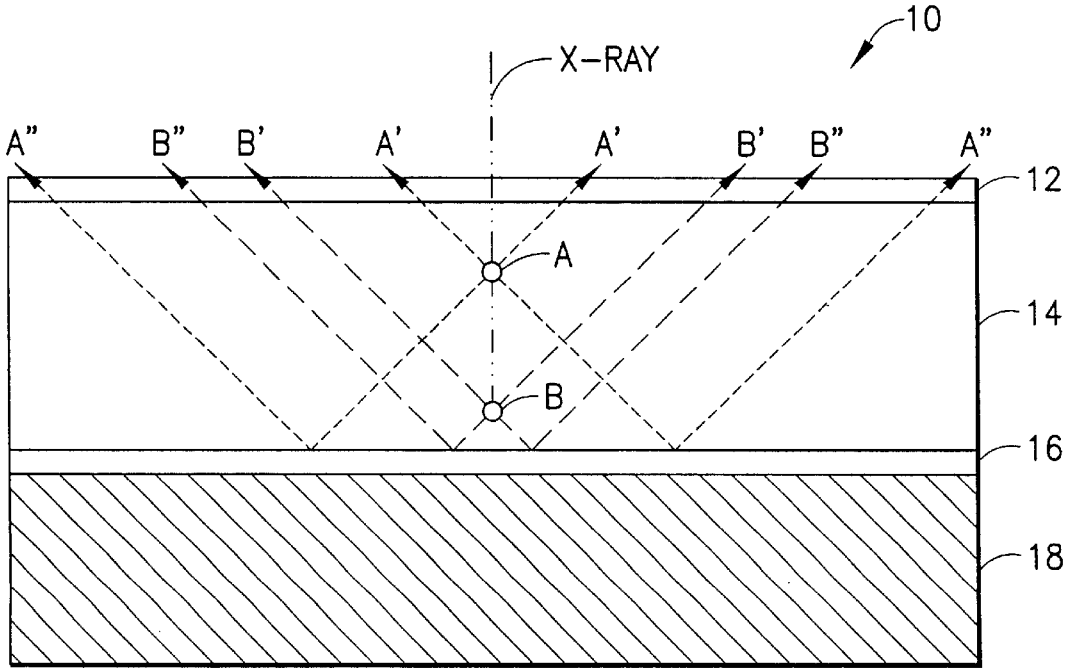
FIG.1 PRIOR ART
FIG. 1 which is a cross-sectional schematic diagram illustrating a conventional intensifying screen and the spectral emission propagation within the screen.

As illustrated by FIG. 2, incident X-ray absorption at locations A and B in the radiation absorbing, luminescent layers 110, 112 produces spectral emissions in the layers which emit isotropically. Spectral emissions in the form of visible light A', B' emitted towards the protective layer have a relatively short path before emerging from the intensifier, thereby producing image information with relatively high spatial resolution. One of the differences between the prior art conventional intensifier depicted in FIG. 1 and the intensifier of the present invention is that the spectral emissions B' from the second luminescent layer 112 travel through the reflective-transmissive layer 114 prior to emerging from the intensifier. These spectral emissions also have a different wavelength than the spectral emissions A' from the first layer. Another difference is that the spectral emissions A" from the first luminescent layer 110 emitted toward the reflective-transmissive layer may be reflected by the reflective-transmissive layer 114 and, if so, then exit the intensifier from the protective layer side. As compared to the reflected spectral emissions A" in the prior art intensifier illustrated in FIG. 1, the reflected spectral emissions A" in the intensifier of the present invention travel a shorter path towards the protective layer and therefore generally have a shorter lateral dispersion from emission site. This increases the spatial resolution of the intensifier for a given screen speed.

It will thus be seen that the objects and advantages set forth above and those made apparent from the preceding descriptions, are efficiently attained and, since certain changes may be made in the above construction without departing from the scope of the invention, it is intended that the matter contained in the above description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween.

What is claimed is:

1. A radiation intensifying screen comprising:

a first radiation absorbing, luminescent layer formed from a first luminescing material capable of producing a spectral emissions maximum at first predetermined wavelength in response to incident radiation;

a second radiation absorbing, luminescent layer formed from a second luminescing material capable of producing a spectral emissions maximum at a second predetermined wavelength which is different from the first predetermined wavelength range in response to incident radiation; and means, disposed between the first and second luminescent layers, for reflecting incident spectral emissions emanating from the first luminescent layer at the first predetermined wavelength and for allowing spectral emissions emanating from the second luminescent layer at the second predetermined wavelength to pass therethrough.

2. The intensifying screen of claim 1, further comprising a backing layer disposed adjacent to the second luminescent layer.

3. The intensifying screen of claim 2, further comprising means, disposed between the second luminescent layer and the backing layer, for reflecting incident spectral emissions emanating from the second luminescent layer at the second predetermined wavelength.

4. The intensifying screen of claim 1, wherein the first predetermined wavelength is less than the second predetermined wavelength, and wherein the means disposed between the first and second luminescent layers is a long pass filter.

5. The intensifying screen of claim 1, wherein the first predetermined wavelength is greater than the second predetermined wavelength, and wherein the means disposed between the first and second luminescent layers is a short pass filter.

6. The intensifying screen of claim 1, further comprising a protective layer disposed over the first luminescent layer.

7. The intensifying screen of claim 1, further comprising a charge coupled device and means for optically coupling spectral emissions emanating from the first and second luminescent layers to the charge coupled device, wherein the coupling means is disposed between the charge coupled device and the first luminescent layer.

8. The intensifying screen of claim 7, wherein the means for optically coupling spectral emissions is a plurality of optical fibers.

9. A radiation intensifying screen comprising:

a first radiation absorbing, luminescent layer formed from a first luminescing material capable of producing spectral emissions of varying wavelengths in a first wavelength range in response to incident radiation;

a second radiation absorbing, luminescent layer formed from a second luminescing material capable of producing spectral emissions of varying wavelengths in a second wavelength range which is greater than the first wavelength range in response to incident radiation; and a reflective-transmissive layer disposed between the first and second luminescent layers, wherein the reflective-transmissive layer is adapted to reflect incident spectral emissions of varying wavelengths emanating from the first luminescent layer which are less than a cutoff wavelength of the reflective-transmissive layer, wherein the reflective-transmissive layer is also adapted to allow spectral emissions of varying wavelengths emanating from the second luminescent layer which are greater than the cutoff wavelength of the reflective-transmissive layer to pass therethrough.

10. The intensifying screen of claim 9, further comprising a backing layer disposed adjacent to the second luminescent layer.

11. The intensifying screen of claim 10, further comprising a secondary reflective layer disposed between the second luminescent layer and the backing layer, wherein the secondary reflective layer is adapted to reflect spectral emissions of varying wavelengths emanating from the second luminescent layer.

12. The intensifying screen of claim 9, further comprising a protective layer disposed over the first luminescent layer.

13. The intensifying screen of claim 9, further comprising a charge coupled device imager and means for optically coupling spectral emissions emanating from the first and second luminescent layers to the charge coupled device, wherein the coupling means is disposed between the charge coupled device and the first luminescent layer.

14. The intensifying screen of claim 13, wherein the means for optically coupling spectral emissions is a plurality of optical fibers.

15. A radiation intensifying screen comprising:

a first radiation absorbing, luminescent layer formed from a first luminescing material capable of producing spectral emissions of varying wavelengths in a first wavelength range in response to incident radiation;

a second radiation absorbing, luminescent layer formed from a second luminescing material capable of producing spectral emissions of varying wavelengths in a second wavelength range, which is less than the first wavelength range, in response to incident radiation; and a reflective-transmissive layer disposed between the first and second luminescent layers, wherein the reflective-transmissive layer is adapted to reflect incident spectral emissions of varying wavelengths emanating from the first luminescent layer which are greater than a cutoff wavelength of the reflective-transmissive layer, wherein the reflective-transmissive layer is also adapted to allow spectral emissions of varying wavelengths emanating from the second luminescent layer which are lower than the cutoff wavelength of the reflective-transmissive layer to pass therethrough.

16. The intensifying screen of claim 15, further comprising a backing layer disposed adjacent to the second luminescent layer.

17. The intensifying screen of claim 16, further comprising a secondary reflective layer disposed between the second luminescent layer and the backing layer, wherein the secondary reflective layer is adapted to reflect spectral emissions of varying wavelengths emanating from the second luminescent layer.

18. The intensifying screen of claim 15, further comprising a protective layer disposed over the first luminescent layer.

19. The intensifying screen of claim 15, further comprising a charge coupled device and means for optically coupling spectral emissions emanating from the first and second luminescent layers to the charge coupled device, wherein the coupling means is disposed between the charge coupled device and the first luminescent layer.

20. The intensifying screen of claim 19, wherein the means for optically coupling spectral emissions is a plurality of optical fibers.

* * * * *